US008677880B2

(12) United States Patent
Bowles et al.

(10) Patent No.: US 8,677,880 B2
(45) Date of Patent: Mar. 25, 2014

(54) COMBINATION STACKABLE MAGAZINE CORES AND OUTER BINDING SKINS FOR CHANGING STYLE AND CAPACITY VERSABILITY OF A FIREARM AND FURTHER INCLUDING DUAL USE FOLLOWER

(75) Inventors: Jordan Bowles, Columbia, MO (US); John L. Overstreet, Fayette, MO (US)

(73) Assignee: 22 Evolution LLC, Columbia, MO (US)

( * ) Notice: Subject to any disclaimer, the term of this patent is extended or adjusted under 35 U.S.C. 154(b) by 145 days.

(21) Appl. No.: 13/297,796

(22) Filed: Nov. 16, 2011

(65) Prior Publication Data

US 2012/0073429 A1 Mar. 29, 2012

Related U.S. Application Data

(63) Continuation-in-part of application No. 12/986,454, filed on Jan. 7, 2011, now Pat. No. 8,387,296, and a continuation-in-part of application No. 12/987,653, filed on Jan. 10, 2011, now Pat. No. 8,479,635.

(60) Provisional application No. 61/415,556, filed on Nov. 19, 2010, provisional application No. 61/321,942, filed on Apr. 8, 2010, provisional application No. 61/321,951, filed on Apr. 8, 2010.

(51) Int. Cl.
*F41A 9/24* (2006.01)

(52) U.S. Cl.
USPC ..... 89/34; 89/33.1; 42/7; 42/50

(58) Field of Classification Search
USPC ..... 89/34, 33.01, 33.1; 42/7, 50, 49.02
See application file for complete search history.

(56) References Cited

U.S. PATENT DOCUMENTS

| | | | | |
|---|---|---|---|---|
| 1,994,392 | A * | 3/1935 | Herlach et al. | 89/33.1 |
| 3,540,142 | A | 11/1970 | Vartanian et al. | |
| 3,570,366 | A | 3/1971 | Nickel | |
| 3,688,640 | A | 9/1972 | Seecamp | |
| 3,846,928 | A | 11/1974 | Ruger et al. | |
| 4,057,003 | A | 11/1977 | Atchisson | |
| 4,127,954 | A * | 12/1978 | Hausmann | 42/50 |
| 4,455,919 | A | 6/1984 | Osborne et al. | |
| 4,893,547 | A | 1/1990 | Atchisson | |
| 5,113,605 | A * | 5/1992 | Kim | 42/50 |
| 5,584,136 | A * | 12/1996 | Boland et al. | 42/7 |

(Continued)

FOREIGN PATENT DOCUMENTS

WO 0029802 A2 5/2000

*Primary Examiner* — Stephen M Johnson
(74) *Attorney, Agent, or Firm* — Gifford, Krass, Sprinkle, Anderson & Citkowski, P.C.; Douglas J. McEvoy

(57) ABSTRACT

A combination magazine and outer skin for a firearm including a magazine core adapted to releasably engage a firearm in communication with an action assembly associated with the firearm. Multiple cores are stackable end-to-end to define a continuous interior, with an end cap engaging an open bottom of a lowermost core. A design indicia exhibits an interior recess and is assembled around the stacked cores. A dual use follower is in use with an uppermost located magazine and maintains the assembly bolt in an open position and following the last cartridge being fired until such time as the magazine is removed. In the further variant, with a BHOA installed in place, the follower activates the BHOA and the bolt to remain in the retracted/open position, following magazine removal.

17 Claims, 6 Drawing Sheets

(56) References Cited

U.S. PATENT DOCUMENTS

| | | | | |
|---|---|---|---|---|
| 5,608,981 | A | 3/1997 | Canaday | |
| 5,638,626 | A * | 6/1997 | Westrom | 42/50 |
| 6,070,352 | A | 6/2000 | Daigle | |
| 6,510,778 | B1 | 1/2003 | Irwin | |
| 6,606,811 | B1 | 8/2003 | Olson | |
| 6,608,811 | B1 | 8/2003 | Holden et al. | |
| 6,851,346 | B1 | 2/2005 | Herring | |
| 6,871,437 | B1 | 3/2005 | Bartozzi et al. | |
| 7,261,029 | B1 | 8/2007 | Davis | |
| 7,364,057 | B2 | 4/2008 | Carroll | |
| 7,497,044 | B2 | 3/2009 | Cammenga et al. | |
| 7,562,614 | B2 | 7/2009 | Polston | |
| 7,568,422 | B1 | 8/2009 | Barrett | |
| 7,661,219 | B1 | 2/2010 | Knight, Jr. et al. | |
| 7,823,312 | B2 | 11/2010 | Faifer | |
| 7,854,083 | B1 * | 12/2010 | Aalto | 42/50 |
| 7,937,872 | B1 | 5/2011 | Fluhr | |
| 2005/0000138 | A1 | 1/2005 | Kiss | |
| 2005/0183310 | A1 | 8/2005 | Finn | |
| 2005/0188579 | A1 * | 9/2005 | Gates | 42/50 |
| 2008/0092733 | A1 | 4/2008 | Leitner-Wise et al. | |
| 2009/0288326 | A1 | 11/2009 | Twardy | |
| 2011/0078937 | A1 | 4/2011 | Rich | |
| 2011/0079132 | A1 | 4/2011 | Rich | |
| 2011/0107902 | A1 | 5/2011 | Quetschke et al. | |

* cited by examiner

FIG. 1
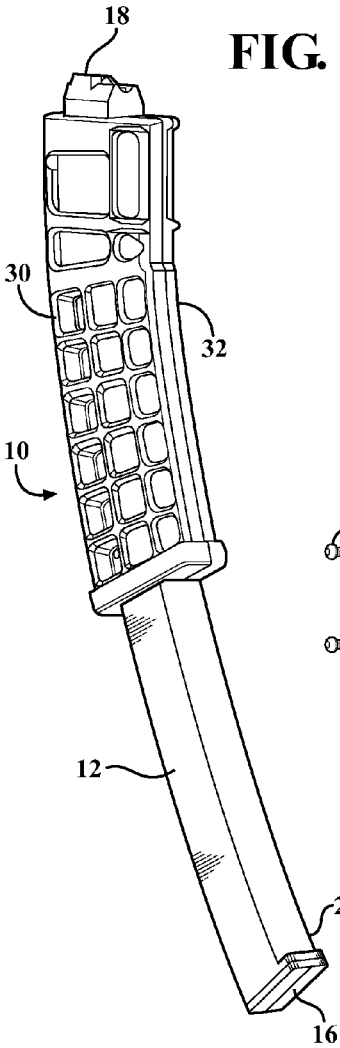
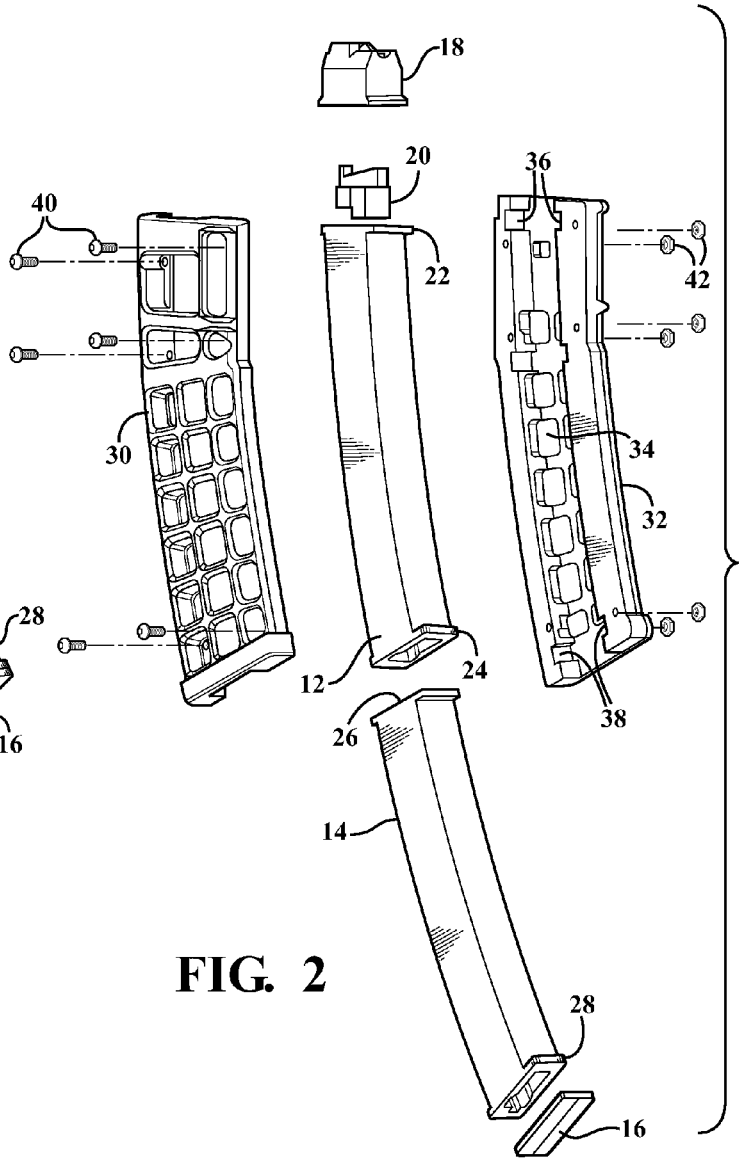
FIG. 2

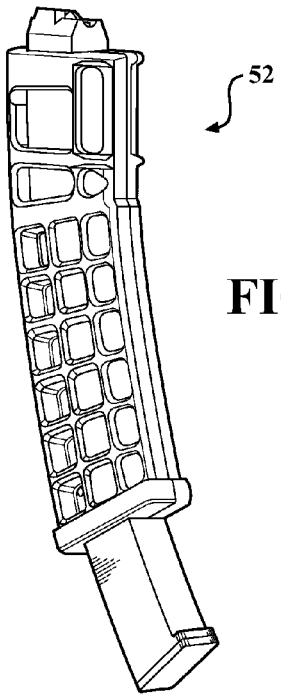
FIG. 7
FIG. 8
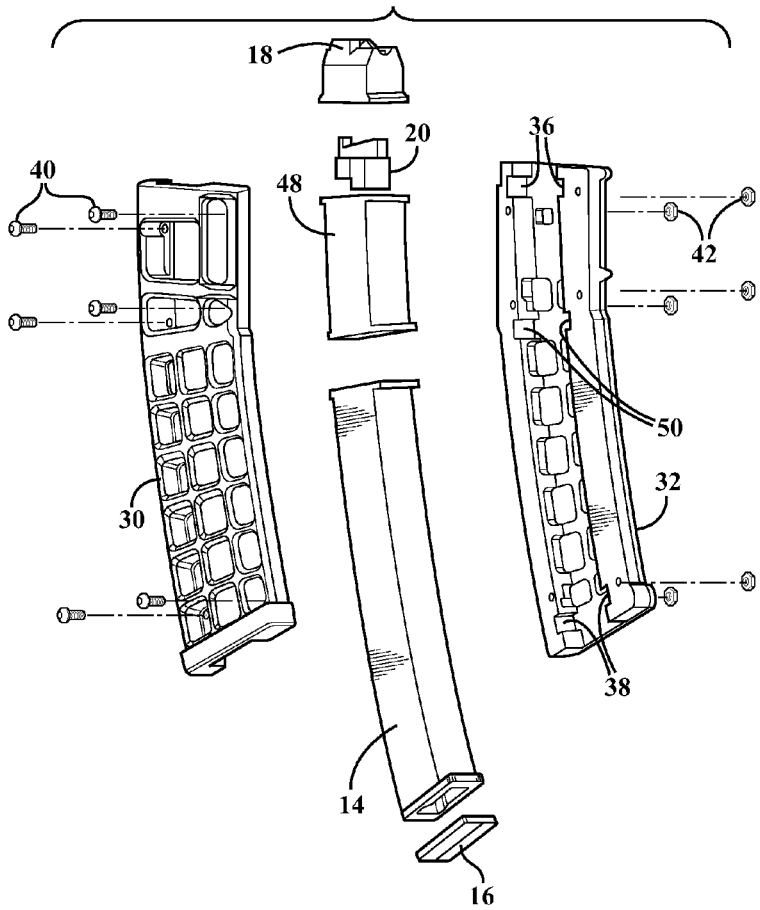

COMBINATION STACKABLE MAGAZINE CORES AND OUTER BINDING SKINS FOR CHANGING STYLE AND CAPACITY VERSABILITY OF A FIREARM AND FURTHER INCLUDING DUAL USE FOLLOWER

CROSS REFERENCE TO RELATED APPLICATIONS

This Application claims the benefit of U.S. Provisional Application 61/415,556 filed on Nov. 19, 2010. This Application is a Continuation-in-part of application Ser. No. 12/986,454 filed on Jan. 7, 2011, now U.S. Pat. No. 8,387,296, which in turns claims the benefit of U.S. Provisional Application 61/321,942 filed on Apr. 8, 2010. This Application is also a Continuation-in-part of application Ser. No. 12/987,653 now U.S. Pat. No. 8,479,635 filed on Jan. 10, 2011, which in turns claims the benefit of U.S. Provisional Application 61/321,951 filed on Apr. 8, 2010.

FIELD OF THE INVENTION

The present invention discloses a combination of ammunition holding cores, including stackable high and low capacity cores, in use with an outer assembleable skin for binding the core or cores in end-to-end stacked fashion and for adapting to different stylings. The invention further includes a dual use follower in use with an uppermost located magazine and which maintains the associated action assembly bolt in an open position, even with a corresponding bolt hold open action (BHOA) assembly removed following the last cartridge being fired, and until the magazine is removed. In the further instance of a BHOA in place, the follower activates the BHOA and the bolt to remain in the retracted/open position, following magazine removal.

BACKGROUND OF THE INVENTION

Cartridge supporting magazines are known, such as for use with a number of firearms. By definition a magazine is an ammunition storage and feeding device within or attached to a repeating firearm. Magazines may be integral to the firearm (fixed) or removable (detachable and function by moving the cartridges (ammunition or bullets) stored in the magazine into a position where they may be loaded into the firearm chamber by the action (reciprocating bolt or otherwise) of the firearm. Magazines come in many shapes and sizes, from bolt action, express rifles that hold only a few rounds to semi-automatic and fully automatic machine guns that hold hundreds of rounds.

The most popular type of magazine in modern rifles and handguns, a box magazine stores cartridges in a column, either one above the other or staggered zigzag fashion. As the firearm cycles, cartridges are moved to the top of the magazine by a follower driven by spring compression to either a single feed position or side-by-side feed positions. Box magazines may be integral to the firearm or detachable.

In the latter instance, a detachable box magazine is a self-contained mechanism capable of being loaded or unloaded while detached from the host firearm and which is attached via a slot in the firearm receiver, usually below the action but occasionally to the side (Sten, FG42, Johnson LMG) or on top (Madsen machine guns, Bren gun, FN P90). When the magazine is empty, it can be detached from the firearm and replaced by another full magazine. This significantly speeds the process of reloading, allowing the operator quick access to ammunition. This type of magazine may be straight or curved, the curve being necessary if the rifle uses rimmed ammunition or ammunition with a tapered case.

SUMMARY OF THE INVENTION

The present invention discloses a combination magazine and outer skin for use with a firearm including an inner magazine core supporting a volume of cartridges and adapted to releasably engage a firearm in communication with an action assembly associated with the firearm. An outer skin is applied around the inner core and depicts a design indicia.

Additional variants include a first magazine core and a second magazine core arranged in end-to-end stacked fashion and defining a continuous and open interior volume, an end cap engaging an open bottom of a lower positioned magazine core. First and second assembleable skins can also be provided, each defining an interior recess and which, upon assembly, seat therebetween at least one magazine core.

The skins may further exhibit enlarged notches in communication with the interior recesses for seating expanded lip edges of the magazine cores. A lower pair of opposing notches are defined in the aligning skins for both aligning and restraining a corresponding pair of expanded lip edges associated with the magazine cores.

A plurality of fasteners are inserted through opposite edge locations of the outer aligning and assembling skins and between which seats said magazine core. The outer skin design can further include, without limitation, a waffle style skin.

A dual use follower in use with an uppermost located magazine and which maintains the associated action assembly bolt in an open position, even with a corresponding bolt hold open action (BHOA) assembly removed following the last cartridge being fired, and until the magazine is removed. In the further instance of a BHOA in place, the follower activates the BHOA and the bolt to remain in the retracted/open position, following magazine removal.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is an assembled perspective of dual stackable high capacity magazine cores in combination with a two piece waffle type assembleable skin according to a first variant;

FIG. 2 is an exploded view of the variant of FIG. 1;

FIG. 7 is an assembled perspective of a both low and high capacity magazine cores in combination with the two piece waffle type skin according to a further variant;

FIG. 8 is an exploded view of the variant of FIG. 7;

DETAILED DESCRIPTION OF THE PREFERRED EMBODIMENTS

Figure 3:
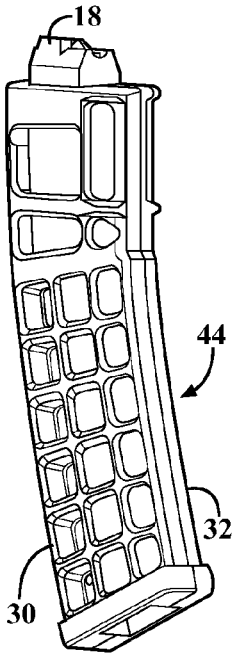
FIG. 3 is an assembled perspective of a single high capacity magazine core in combination with the two piece waffle type skin according to a further variant.

The present invention discloses a combination of ammunition holding cores, including stackable high and low capacity cores, in use with an outer assembleable skin for binding the core or cores in end-to-end stacked fashion and for adapting to different stylings, this in comparison to traditional magazines which are limited in both styling and capacity.

Referring first to FIG. 1, an assembled perspective is illustrated at 10 of dual stackable high capacity magazine cores in combination with a two piece waffle type assembleable skin according to a first variant. These are further shown in the exploded view of FIG. 2 and include a pair of inner core ammunition holding magazines 12 and 14.

The core ammunition magazines 12 and 14 are arranged in stacked fashion so as to define a continuous and open interior volume, with each exhibiting an elongate extending, arcuate and rectangular open interior with opposite open upper and lower ends. As shown, a bottom closing cap 16 is attached to the open bottom of the lower positioned magazine 14.

At the opposite upper end of the upper positioned magazine 12, additional cartridge feed components are provided and include an upper housing 18 which assembles with an upper end of the core ammunition magazine 12 as shown in order to facilitate installation into the receiving chamber associated with the upper receiver of the rifle. A version of a dual action follower is further depicted at 20 (with more particular variants of followers integrated with first and second applications being subsequently described in reference to FIGS. 10-11). Such arrangement of components interface the magazine with the firearm and permit the cartridges to be advanced in sequential and orderly fashion within the firearm.

The magazines 12 and 14 are constructed of a suitable metal or heavy duty polymeric material and each can further include, at opposite ends, a projecting lip or ledge, see at 22 and 24 for upper positioned magazine 12 and further at 26 and 28 for lower positioned magazine 14. This shaping of the magazines 12 and 14 facilitates both end to end stacking in a fashion which aligns the inner defined cartridge supporting volume, as well as providing for secure engagement upon application of the outer skin which is further depicted by first assembleable half 30 and second assembleable half 32.

The skins 30 and 32 are each generally elongated and mating in configuration, with each exhibiting an outer design surface, such as a waffle, honeycomb or other suitable pattern to enhance gripping, and which can be constructed of a suitable semi-rigid or rigid polymeric or like material. The inner opposing surfaces of the skins 30 and 32, as best depicted by selected skin 32 in FIG. 2, each exhibit a recessed configuration such as is referenced at 34 for skin 32 and which matches one side of the profile established by the magazine 12. Enlarged notches are also configured within each of the opposing and matingly aligning surfaces of each skin in communication with the inner recessed configurations (e.g. again at 34) and include such as that shown at 36 for seating upper lip edge 22 of magazine 12 as well as at 38 for likewise seating opposing and aligning lip edges 24 and 26 of end to end stacked magazines 12 and 14.

In this fashion, the skins 30 and 32 are assembled such that they surround and encase the magazines 12 and 14 in the manner depicted in FIG. 1, the result of which being that an overall magazine of maximized cartridge supporting capacity is created from any number of end-to-end stackable magazines 12, 14, et seq. Further, and given the supporting and retaining configuration of the assembled skins 30 and 32, the lower magazine 14 is prevented from become disengaged or otherwise misaligned from the upper magazine 12, this again due to the restraining and locating aspects of the enlarged seating notches and including those depicted at 38 which seat the aligning lip edges 24 and 26 of the magazines so as to maintain the integrity of the overall inner cartridge supporting volume.

The outer assembling skins 30 and 32 can be secured together in a number of differing fashions, such as employing clips and the like. However, and as is further depicted, one engagement scheme can include a first plurality of screws 40 which assemble (from exterior of skin 30) through aligning apertures formed through both of the skins 30 and 32 upon assembly around the magazine(s) and exhibited on outer perimeter locations between which the profile of the magazine 12 seats. A corresponding plurality of nuts 42 engage projecting ends of the screws 40 from an opposite face of the skins (skin 32) to bind the skins in the manner shown in FIG. 1.

Figure 4:
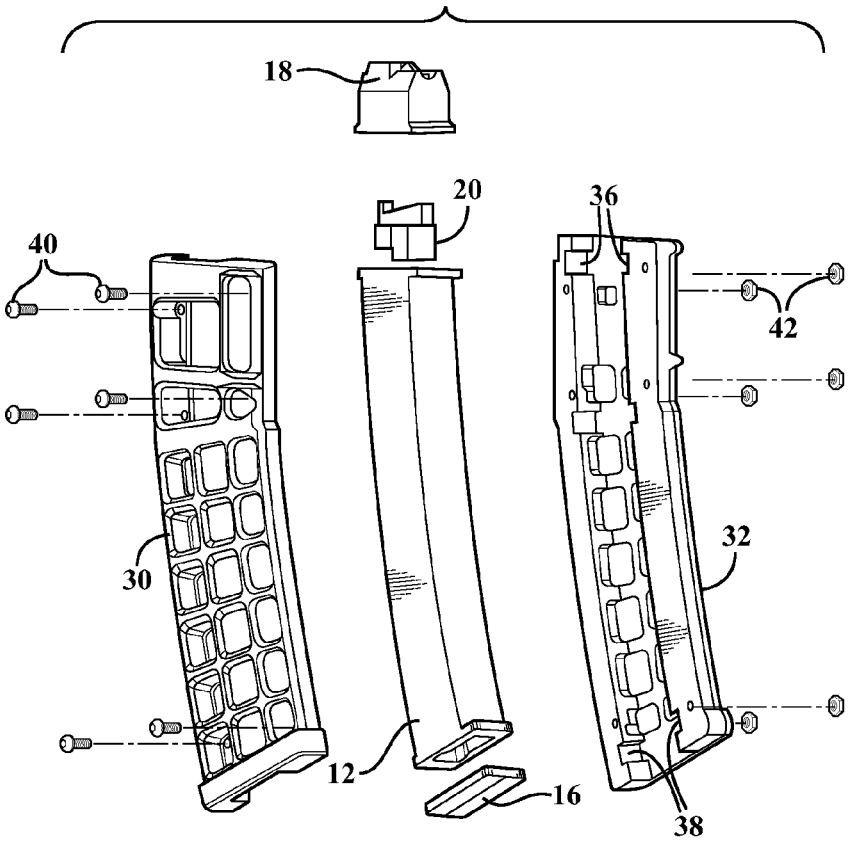
FIG. 4 is an exploded view of the variant of FIG. 3.

Referring both to the assembled view of FIG. 3 and the exploded view of FIG. 4, shown at 44 is a further variant of a single high capacity magazine core 12 in combination with the two piece waffle type skins 30 and 32. The skins 30 and 32 are identical to that shown in FIGS. 1 and 2, such that a repetitive description is unnecessary. Further, the second magazine 14 in the variant of FIG. 1 is removed with the assembled combination 44 being limited to a single cartridge supporting magazine 14 with the end closing cap 16 secured in place (and further in this variant being restrained within the enlarged and seating notch such as is again representatively shown at 38 in selected skin 32).

Figure 5:
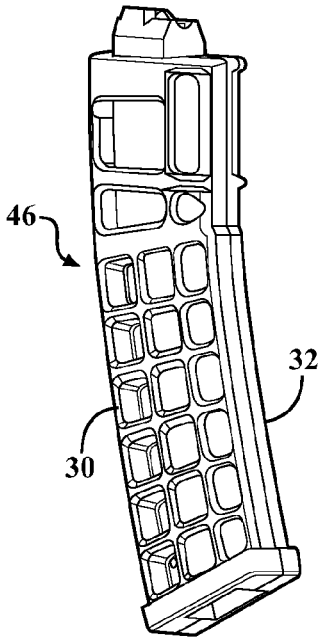
FIG. 5 is an assembled perspective of a single low capacity magazine core in combination with the two piece waffle type skin according to a further variant.
Figure 6:
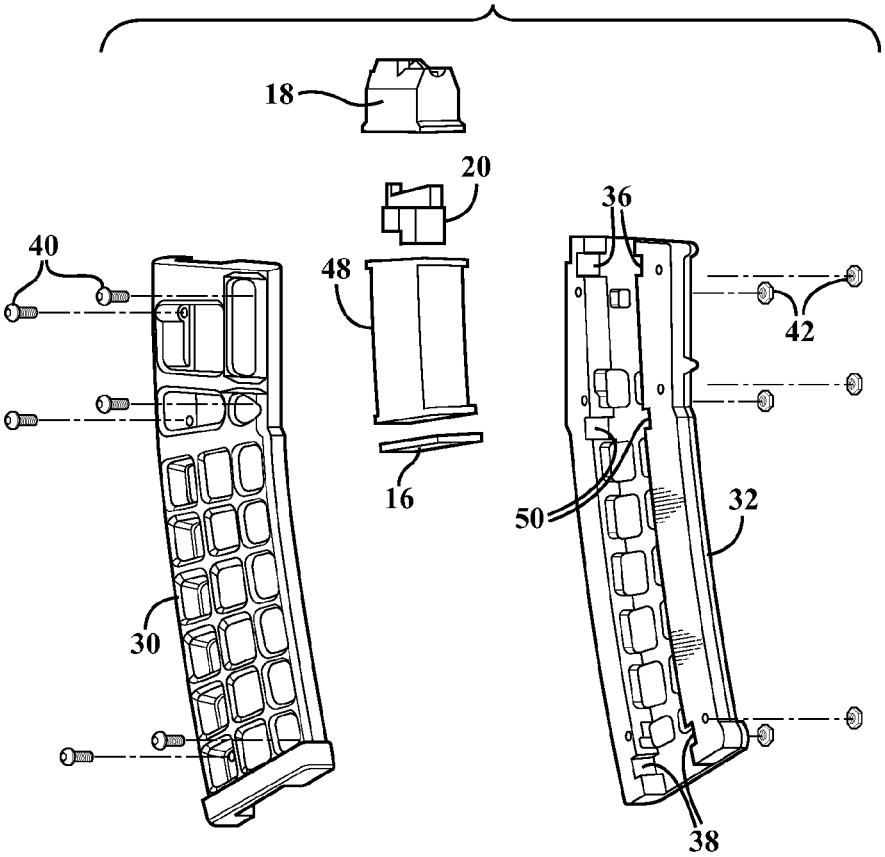
FIG. 6 is an exploded view of the variant of FIG. 5.

Proceeding to FIGS. 5 and 6, successive assembled perspective and exploded views are shown at 46 of a further variant exhibiting a single low capacity magazine core, see as shown at 48 and as compared to the higher capacity magazines 12 and 14. The core 48 is provided in combination again with the two piece waffle type skin 30 and 32 as previously described and further such that the skins 30 and 32, upon alignment, exhibit a further intermediate positioned and aligning/enlarged notch in communication with its recessed and magazine seating interior (see notch 50 for selected skin 32 and which is also evident in each of the illustrations of FIGS. 2 and 4). End cap 16 is again shown, in this instance closing off the open bottom of reduced sized magazine core 48.

FIG. 7 is an assembled perspective and FIG. 8 a corresponding exploded view of a further arrangement 52 depicting both low 48 and high 14 capacity magazine cores depicted in end-to-end stacked fashion in combination with the two piece waffle type skin 12 and 14 according to a further and intermediate capacity variant between that disclosed in the variants of FIGS. 1 and 3. The variant 52 again employs all previously described components according to a yet further inter-changeable combination.

Figure 9:
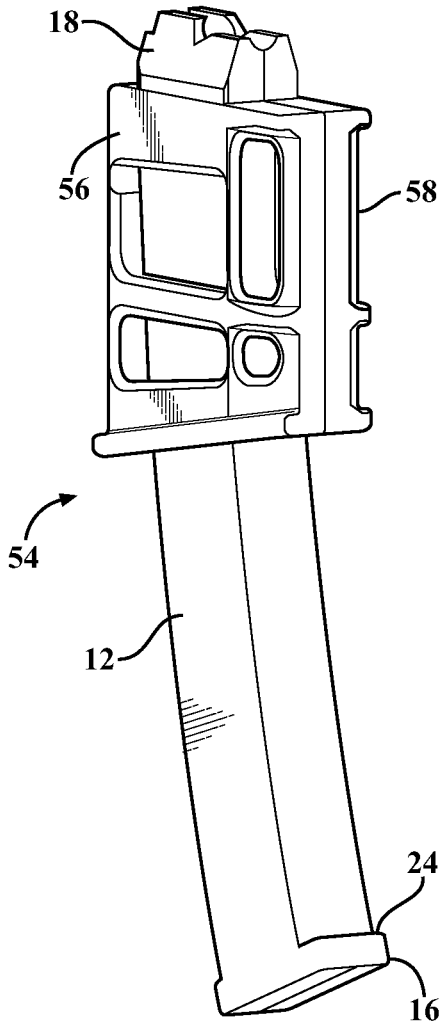
FIG. 9 is an assembled perspective of a single high capacity magazine core in combination with a minimal dimensioned waffle type skin in combination.

FIG. 9 illustrates at 54 an assembled perspective of a single high capacity magazine core, such as previously described at 12 with end cap 16 affixed, in combination with a minimal dimensioned waffle type skin similar to that previously described and as is illustrated in assembled fashion by skin halves 56 and 58. Although not shown, the binding halves 56 and 58 exhibit the same interior configuration as associated with the skins 30 and 32 and are configured to assemble about any suitable magazine core such as at 12 or 48. Further, the design profile is again shown by a waffle type or honeycomb pattern but can again be changed to any other suitable textured and/or designed pattern as desired.

As depicted throughout the several embodiments described herein, the present inventions disclose a variety interchangeable skin designs in combination with varying combinations of differently sized and end-to-end stacked magazine cores in order to provide a maximum of design customization and cartridge capacity.

Figure 10:
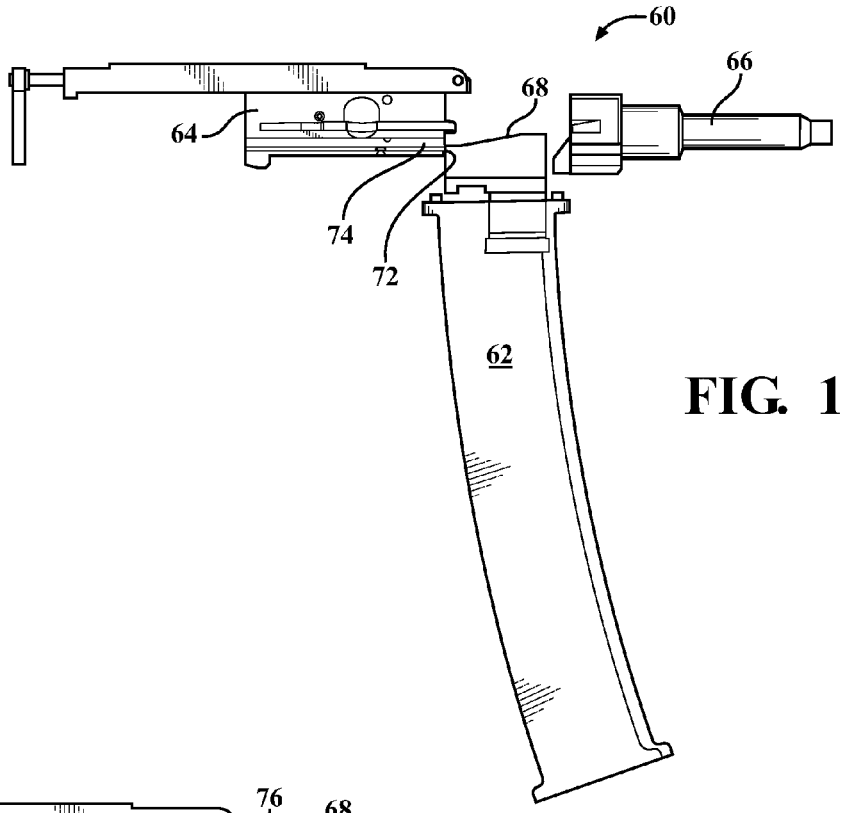
FIG. 10 is side partial cutaway view of an upper magazine with upwardly biasing follower element in a first operative variant without a bolt hold open action (BHOA) installed and which will maintain the reciprocating bolt in a rearwardly retracted/open position until such time as the magazine is removed.

Referring now to FIG. 10, a side partial cutaway view is generally shown at 60 of an uppermost installatable magazine 62 (such as exhibiting a surrounding assembleable skin as previously described), and which is arranged in relation to selectively illustrated portions of an upper receiver of the rifle which are represented by action assembly bolt 64 and a forward positioned chamber adaptor 66. An upwardly biasing follower element 68 is depicted in a first operative variant without a bolt hold open action (BHOA) installed (see further as partially represented at 70 in FIG. 11 over an open magazine well defined within the upper receiver) and which will maintain the reciprocating bolt 64 in a rearwardly retracted/open position until such time as the magazine is removed or the follower 68 otherwise retracted downwardly, at which point an engaging ledge 72 of the follower is withdrawn from a first position in engagement with an opposing location 74 of the bolt 64, with the result being the forward closing of the bolt in a direction toward the chamber adaptor 66.

Figure 11:
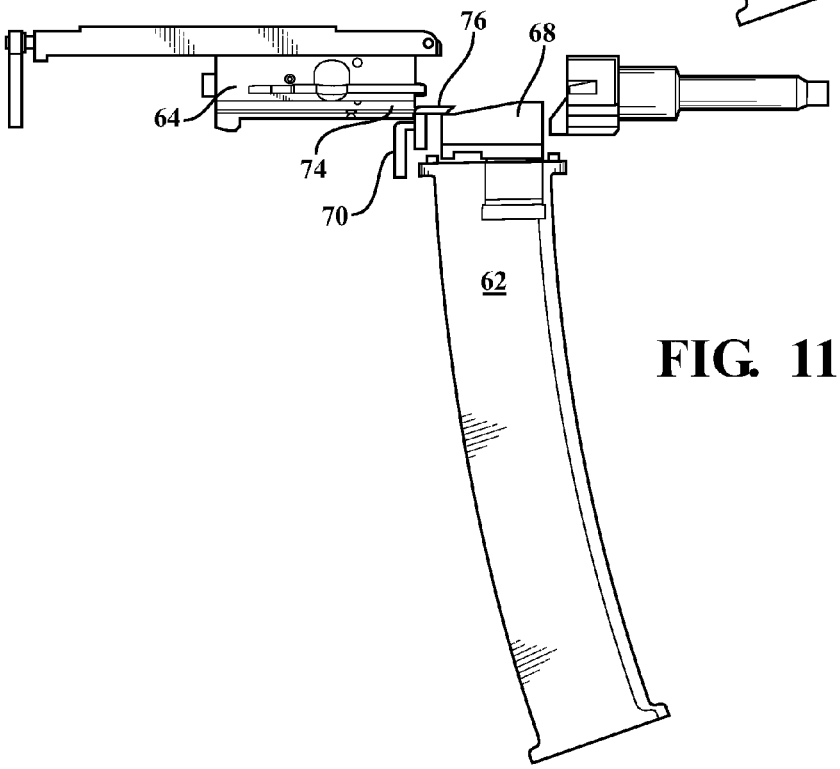
FIG. 11 is a slightly modified illustration with respect to what is shown in FIG. 10 and including the installation of a BHOA by which the associated action assembly bolt is maintained in the retracted/open position following magazine removal.

Referring finally to FIG. 11, a similar magazine 62 is again illustrated with respect to what is shown in FIG. 10, and again includes the uppermost displaceable follower 68 in an alternate application to that previously described in FIG. 10. For purposes of FIG. 11, the follower 68 is arranged in concert with the BHOA (bolt hold open) element 70, and by which the associated action assembly and bolt 64 is maintained in the retracted/open position both prior to and following removal of the magazine 62 and follower 68. The bolt hold open 70 is similar in construction to those previously disclosed in copending applications U.S. Ser. No. 12/986,454 filed Jan. 7, 2011 and Ser. No. 12/987,653 filed Jan. 10, 2011 and includes a catch actuator 76 which is supported in elevatable fashion relative to an end of the actuator housing.

The follower component, upon contacting and upwardly displacing a catch actuator 76 incorporated into the BHOA 72, engages the bolt location 74 in a retracted/opened maintained position again as shown. Following retraction of the magazine and associated follower, the bolt 64 is maintained in its retracted position until such time as the catch actuator 76 is downwardly displaced a limited distance relative to the BHOA 70 frame for releasing the bolt 64 for forward travel.

Having described our invention, other and additional preferred embodiments will become apparent to those skilled in the art to which it pertains, and without deviating from the scope of the appended claims:

We claim:

1. A magazine for use with a firearm, comprising:

at least first and second inner magazine cores arranged in end-to-end stacked fashion and defining a continuous and open interior for supporting a volume of cartridges;

an upper housing which assembles with an upper end of an upper selected one of said magazine cores, said upper housing adapted to releasably engage a receiving chamber associated with an upper receiver of the firearm in communication with an action assembly bolt and forward positioned chamber adaptor associated with the firearm; and an outer skin having first and second assembleable halves applied around said inner cores and depicting a design, a plurality of fasteners affixing said skins around said cores in order to retain said cores in said end-to-end stacked fashion.

2. The magazine as described in claim 1, said inner magazine core further comprising an end cap engaging an open bottom of a lower positioned magazine core.

3. The magazine as described in claim 1, said assembleable halves of said outer skin each defining an interior recess seating therebetween said magazine cores.

4. The magazine as described in claim 3, said skins further comprising enlarged notches in communication with said interior recesses for seating expanded lip edges of said magazine cores.

5. The magazine as described in claim 4, further comprising a lower pair of opposing notches defined in said skins aligning and restraining a corresponding pair of expanded lip edges associated with said magazine cores.

6. The magazine as described in claim 5, further comprising said fasteners inserting through opposite edge locations of said assembleable halves between which seats said magazine core.

7. The magazine as described in claim 1, said outer skin design further comprising at least a waffle style skin.

8. The magazine as described in claim 1, said magazine core further comprising an upwardly displaceable follower exhibiting a configured ledge and engaging and maintaining the action assembly bolt in an open position until retraction of said follower.

9. The magazine as described in claim 8, further comprising a bolt hold open action assembly mounted over an open magazine well within the upper receiver, said action assembly including a catch actuator which is elevated by said follower for engaging and maintaining said bolt in an open position both prior to and following magazine removal.

10. A magazine for use with a firearm, comprising:

a pair of inner magazine cores arranged in end-to-end stacked fashion and defining a continuous and open interior volume supporting a volume of cartridges;

an upper housing which assembles with an upper end of an upper located of said inner magazine cores, said upper housing adapted to releasably engage a receiving chamber associated with an upper receiver of the firearm in communication with an action assembly bolt and forward positioned chamber adaptor associated with the firearm;

first and second assembleable skins depicting a design, each of said skins defining an interior recess and which, upon assembly, seating therebetween said inner cores, said skins further comprising enlarged notches in communication with said interior recesses for seating expanded lip edges of said magazine cores;

a lower pair of opposing notches defined in said skins aligning and restraining a corresponding pair of expanded lip edges associated with said magazine cores; and a plurality of fasteners inserting through opposite edge locations of said outer aligning and assembling skins between which seats said magazine cores.

11. The magazine as described in claim 10, further comprising an end cap engaging an open bottom of a lower positioned magazine core.

12. The magazine as described in claim 10, said outer skin design further comprising at least a waffle style skin.

13. The magazine as described in claim 10, said magazine core further comprising an upwardly displaceable follower exhibiting a configured ledge and engaging and maintaining the action assembly bolt in an open position until retraction of said follower.

14. The magazine as described in claim 13, further comprising a bolt hold open action assembly mounted over an open magazine well within the upper receiver, said action assembly including a catch actuator which is elevated by said follower for engaging and maintaining said bolt in an open position both prior to and following magazine removal.

15. The magazine as described in claim 10, said inner magazine cores each further comprising projecting lips at opposite ends.

16. The magazine as described in claim 10, said magazines further comprising at least one of a metal or polymeric construction.

17. A combination magazine and outer skin for use with a firearm, comprising:

a pair of inner magazine cores arranged in end-to-end stacked fashion and defining a continuous and open interior for supporting a volume of cartridges, said inner magazine cores each having projecting lips at opposite ends;

an upper housing which assembles with an upper end of an uppermost located of said inner magazine cores, said upper housing adapted to releasably engage a receiving chamber associated with an upper receiver of the firearm; and a decorative skin assembleable around and encasing said stacked cores with an interior of said skin seating said projecting lips.

* * * * *